US008727818B2

(12) United States Patent
Kossak

(10) Patent No.: US 8,727,818 B2
(45) Date of Patent: May 20, 2014

(54) TERMINATION BAR ASSEMBLY

(75) Inventor: Robert W. Kossak, Lemont, IL (US)

(73) Assignee: Panduit Corp., Tinley Park, IL (US)

( * ) Notice: Subject to any disclaimer, the term of this patent is extended or adjusted under 35 U.S.C. 154(b) by 14 days.

(21) Appl. No.: 13/546,118

(22) Filed: Jul. 11, 2012

(65) Prior Publication Data

US 2014/0017924 A1 Jan. 16, 2014

(51) Int. Cl.
*H01R 11/09* (2006.01)

(52) U.S. Cl.
USPC ..... 439/798; 439/718; 439/806

(58) Field of Classification Search
USPC ..... 439/798, 806, 718
See application file for complete search history.

(56) References Cited

U.S. PATENT DOCUMENTS 3,033,913 A * 5/1962 Dietze ..... 174/60
3,133,779 A * 5/1964 Stanback ..... 439/798
3,467,768 A * 9/1969 Shorey ..... 174/138 F
4,195,194 A * 3/1980 Kuster et al. ..... 174/59
4,201,433 A * 5/1980 Caldwell ..... 439/98
4,237,198 A 12/1980 Eby et al.
4,415,044 A * 11/1983 Davis ..... 174/138 F
4,820,206 A * 4/1989 Jullien et al. ..... 439/782
5,145,388 A * 9/1992 Brownlie et al. ..... 439/142
D365,510 S 12/1995 Kiely et al.
5,533,912 A * 7/1996 Fillinger et al. ..... 439/521
5,690,516 A * 11/1997 Fillinger ..... 439/798
5,727,314 A 3/1998 Ashcraft
5,848,913 A 12/1998 Ashcraft
5,931,708 A 8/1999 Annas et al.
5,960,516 A 10/1999 Zoroufy et al.
6,238,234 B1 * 5/2001 Sedlecky ..... 439/412
6,325,675 B1 * 12/2001 Harmeyer ..... 439/709
6,347,967 B1 * 2/2002 Tamm ..... 439/806
6,361,381 B1 * 3/2002 Koebbe ..... 439/810
6,497,592 B1 * 12/2002 Beadle ..... 439/814
6,551,135 B2 * 4/2003 Stekelenburg ..... 439/575
6,676,454 B2 * 1/2004 De France ..... 439/806
6,854,996 B2 * 2/2005 Yaworski et al. ..... 439/276
6,939,183 B2 9/2005 Ferretti et al.
7,014,514 B2 3/2006 Zahnen
7,044,776 B2 5/2006 King, Jr. et al.
7,134,921 B2 * 11/2006 Siracki et al. ..... 439/798
7,175,484 B1 * 2/2007 Tamm et al. ..... 439/798
7,247,059 B2 7/2007 Greaves
7,416,454 B2 8/2008 Tamm et al.
7,481,684 B2 1/2009 Bundren
7,520,786 B2 4/2009 Triantopoulos et al.

(Continued)

OTHER PUBLICATIONS

Arlington Industries, Inc., Grounding Bridge in Zinc and Bronze, 2 pages, 2009.

(Continued)

*Primary Examiner* — Neil Abrams
(74) *Attorney, Agent, or Firm* — Christopher S. Clancy; Aimee E. McVady

(57) ABSTRACT

A termination bar assembly comprises a termination bar including opposing ends, a top surface and opposing side surfaces, wherein the opposing side surfaces define a plurality of openings for receiving one or more electrical conductors, The termination bar assembly may further comprise a clamping arrangement for receiving and holding a main conductor. The clamping arrangement may comprise a central body portion and at least one flange extending therefrom. The assembly can further comprise a base for holding said termination bar and affixing said termination bar to a mounting surface and a dome releasably securable to said base.

18 Claims, 13 Drawing Sheets

(56) References Cited

U.S. PATENT DOCUMENTS

| | | | | |
|---|---|---|---|---|
| D592,603 | S | 5/2009 | Sweeney et al. | |
| 7,537,467 | B1 | 5/2009 | Gretz | |
| D593,500 | S | 6/2009 | Sweeney et al. | |
| D593,957 | S | 6/2009 | Sweeney et al. | |
| D594,825 | S | 6/2009 | Sweeney et al. | |
| D594,826 | S | 6/2009 | Sweeney et al. | |
| 7,540,758 | B2 * | 6/2009 | Ho | 439/394 |
| 7,591,656 | B1 | 9/2009 | Gretz | |
| 7,618,299 | B2 | 11/2009 | Ferretti | |
| 7,717,740 | B2 * | 5/2010 | Zahnen et al. | 439/521 |
| D626,087 | S | 10/2010 | Kiely | |
| 7,896,714 | B2 * | 3/2011 | Moist | 439/793 |
| 7,931,508 | B1 | 4/2011 | Carr | |
| 7,942,679 | B1 | 5/2011 | Gretz | |
| D648,281 | S | 11/2011 | Cerasale | |
| D652,388 | S | 1/2012 | Cerasale | |
| 8,272,883 | B1 * | 9/2012 | Smith | 439/95 |
| 8,277,263 | B1 * | 10/2012 | Smith | 439/779 |
| 8,425,264 | B2 * | 4/2013 | Michell et al. | 439/789 |
| 2005/0054245 | A1 | 3/2005 | Greaves | |
| 2009/0163087 | A1 | 6/2009 | Sweeney et al. | |

OTHER PUBLICATIONS

Bridgeport Fittings, Inc., Mighty-Bond™ Grounding Products, 2 pages, 2010.

Burndy®, Type BDT Bondit™ Intersystem Bonding Connector, 1 page, undated.

Webpage from www.benfranklin.com showing Eaton Corp.'s Msegr1cs Bonding Terminal, 1 page, printed Sep. 28, 2011.

Erico®, Intersystem Bonding Termination, 1 page, undated.

Webpage from www.garvinindustries.com showing Garvin Industries' Corrosion Resistant Aluminum Intersystem Bonding Bridge with 6-2 AWG Grounding Electrode Conductor and (4) 144 Bonding Conductors, 1 page, printed Jan. 27, 2012.

Greaves Intersystem Bonding Termination Bar Kits, 1 page, Jun. 19, 2008.

Webpage from www.harger.com showing Harger's Intersystem Bonding Connection, 1 page, printed Jan. 27, 2012.

Webpage from www.lowes.com showing Ideal Intersystem Bonding Terminal, 1 page, printed Sep. 28, 2011.

ILSCO, Clearground Intersystem Bonding, 1 page, undated.

Webpage from www.globalspec.com showing NSI Industries' Bonding Connector, 1 page, printed Sep. 28, 2011.

PowerEdge Products, LLC, Terminator Jr.™, 1 page, printed Jan. 27, 2012.

Webpage from www.sigmaelectric.com showing Sigma Electric Manufacturing Corp's Intersystem Bonding Bridge, 1 page, printed Jan. 27, 2012.

Webpage from www.amazon.com showing Thomas & Betts' Carlon IBT3C Grounding Bar IBT with Clamp, 2 pages, printed Jan. 4, 2012.

* cited by examiner

TERMINATION BAR ASSEMBLY

TECHNICAL FIELD

The present invention relates to a termination bar assembly for bonding electrical conductors from multiple systems to a main conductor.

BACKGROUND

The National Electrical Code (NEC) regulates the grounding of data, cable TV, and phone lines. "Grounding" is the establishment of an electrical connection to earth through a path of sufficiently low impedance. As it relates to data, cable TV, and phone lines, grounding assists in preventing destruction of electrical components and property damage from superimposed voltage, for example from lightning and voltage transients. Grounding the various connections to the earth also helps reduce static charges on equipment surfaces and ensure proper performance of sensitive electronic equipment. Grounding communications equipment to the earth reduces high voltage from lightning and keeps it from entering into the building or structure via metal cables or raceways.

Typically, the grounding of data, cable TV, phone lines and other electrical lines occurs as close as possible to the point at which the lines enter the building. Usually this is at the alternating current (AC) service panel or electrical panel that includes the meter box for totaling electrical usage. Prior to the NEC's regulations, grounding systems provided essentially one ground connection for grounding all AC voltage leading into the service panel.

There is needed a device for establishing grounding connections to earth for various services, including various phone, data, and cable TV connections that permits easy connection and disconnection of those services.

SUMMARY OF INVENTION

In one embodiment of the present invention, there is provided a termination bar assembly comprising a termination bar including opposing ends, a top surface and opposing side surfaces, wherein the opposing side surfaces define a plurality of openings for receiving one or more electrical conductors, the termination bar further comprising an opening with a "lay-in" feature for receiving a main continuous conductor; and a clamping arrangement associated with the termination bar for receiving and holding the main conductor, the clamping arrangement capable of being disposed in a lay-in position for receiving said main conductor, said clamping arrangement comprising a central body portion and at least one flange extending therefrom. The at least one flange can comprise an angled surface relative to a horizontal plane and the termination bar can comprise an angled surface relative to the horizontal plane positioned at substantially the same angle as the angled surface of said at least one flange. The at least one flange can also comprise a first flange and a second flange positioned on opposing sides of said central body portion, wherein each of the first and second flanges comprises an angled surface relative to a horizontal plane. The clamping arrangement can comprise a screw and the central body can comprises a hole for receipt of the screw.

In some embodiments, the termination bar assembly can further comprise a detachable cover comprising a base for receiving said termination bar and affixing said termination bar to a mounting surface; a dome releasably securable to said base; and at least one flange positioned on a side surface of said base, said at least one flange for elevating said dome above said mounting surface when said dome is secured to said base. The dome and base may comprise a snap-in connector arrangement comprising a tab and a receptacle for receipt of said tab, said tab and receptacle positioned on either or both of said base and dome. The at least one flange positioned on the side surface of the base can comprise a first portion at a first elevation and a second portion at a second elevation, wherein the first and second elevations are different.

In another aspect of the invention, there is provided termination bar assembly comprising a termination bar including opposing ends, a top surface and opposing side surfaces, wherein the opposing side surfaces define a plurality of openings for receiving one or more electrical conductors, the termination bar further comprising an opening with a "lay-in" feature for receiving a main conductor; and a clamping arrangement associated with the termination bar for receiving and holding the main conductor and comprising a central body portion positioned to overlay said main conductor, said clamping arrangement capable of being disposed in a lay-in position for receiving said main conductor, said clamping arrangement configured to resist rotation when the main conductor is being secured in position. The same additional features described above can be employed with this embodiment.

In another embodiment of the invention, there is provided a termination bar assembly comprising a termination bar including opposing ends, a top surface and opposing side surfaces, wherein the side surfaces define a plurality of openings for accommodating one or more electrical conductors, the termination bar further comprising an opening for receiving a main conductor; and a clamping arrangement associated with the termination bar for receiving and holding the main conductor, the clamping arrangement capable of being disposed in a lay-in position for receiving said main conductor, said clamping arrangement comprising a central body portion positioned between a first flange and a second flange, wherein each of said first and second flanges comprises an angled surface, with an angled surface relative to a horizontal plane of at least one of said flanges comprising substantially the same angle as an angled surface relative to the horizontal plane of said termination bar.

In yet another embodiment, there is provided a termination bar assembly comprising a termination bar including opposing ends, a top surface and opposing side surfaces, wherein the side surfaces define a plurality of openings for receiving one or more electrical conductors, including a main conductor; a clamping arrangement associated with the termination bar for receiving and holding the main conductor, the clamping arrangement capable of being disposed in a lay-in position for receiving said main conductor; a base for holding said termination bar and affixing said termination bar to a mounting surface; a dome releasably securable to said base; and at least one flange positioned on a side surface of said base, said at least one flange for elevating said dome above said mounting surface when said dome is secured to said base. The at least one flange may comprise a portion exhibiting a substantially L-shaped profile. In addition, the termination bar can comprise an angled opening for receiving a screw to secure said main conductor into position.

BRIEF DESCRIPTION OF DRAWINGS

The foregoing aspects and other features of the invention are explained in the following description, taken in connection with the accompanying drawings, wherein.

DETAILED DESCRIPTION

A "termination bar assembly" bonds electrical conductors from multiple systems to a main conductor. A "conductor" is a bare or insulated wire, combination of wires not insulated from one another, rod, pole or the like, which is suitable for carrying an electric current, or the body of a conductive material so constructed that it serves as a carrier of electric current. "A main conductor" refers to a conductor connected to a termination bar and in communication with the earth to provide grounding.

Figure 1:
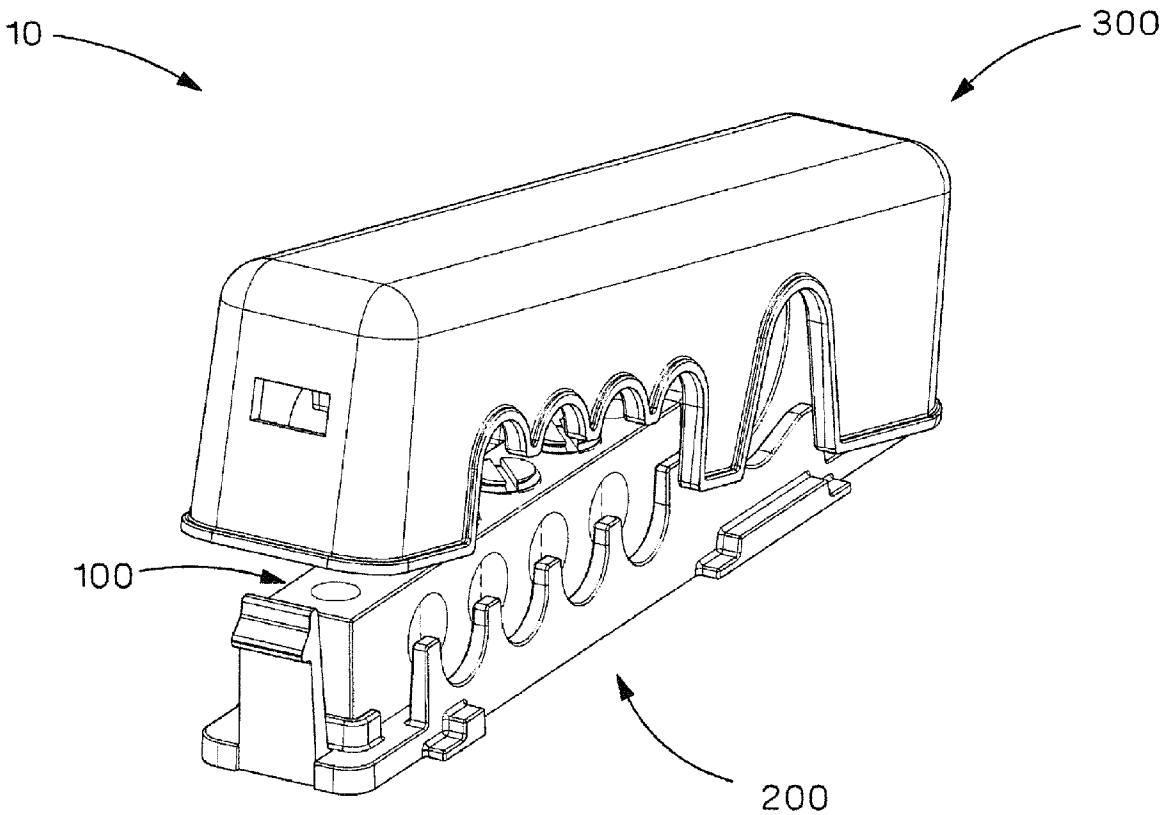
FIG. 1 is a perspective view of a termination bar assembly including a termination bar, a base and a dome according to one embodiment of the present invention.
Figure 1A:
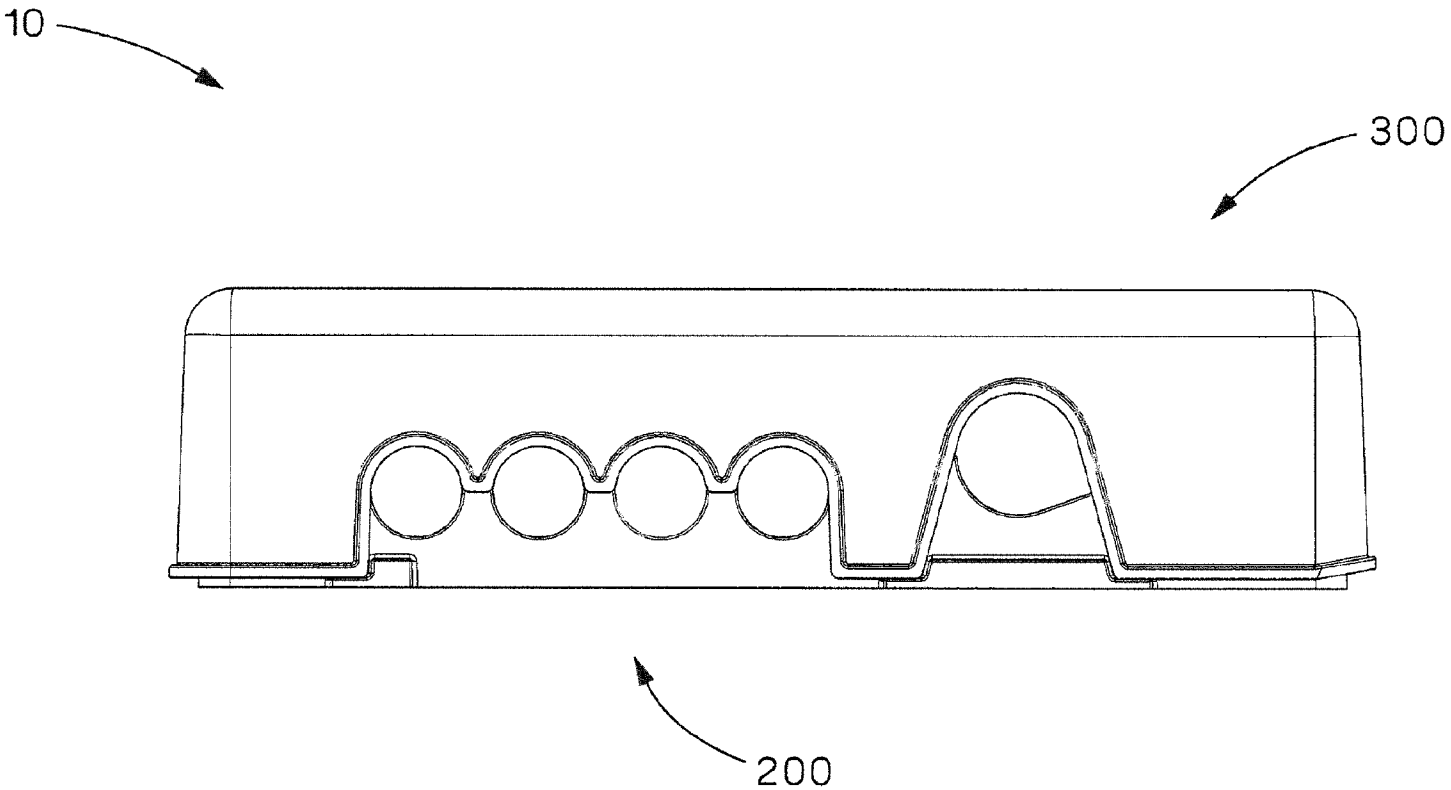
FIG. 1A is a side view of the termination bar assembly of FIG. 1 with the dome positioned on the base.

With reference to FIGS. 1 and 1A, a first embodiment of the termination bar assembly 10 of the present invention is shown. The assembly 10 includes a termination bar 100, and a detachable cover comprising a base 200 and a dome 300. This assembly is particularly useful for attachment to a previously installed ground wire in order to provide additional grounding terminals for multiple systems, such as for cable TV, phone and data systems.

Figure 2:
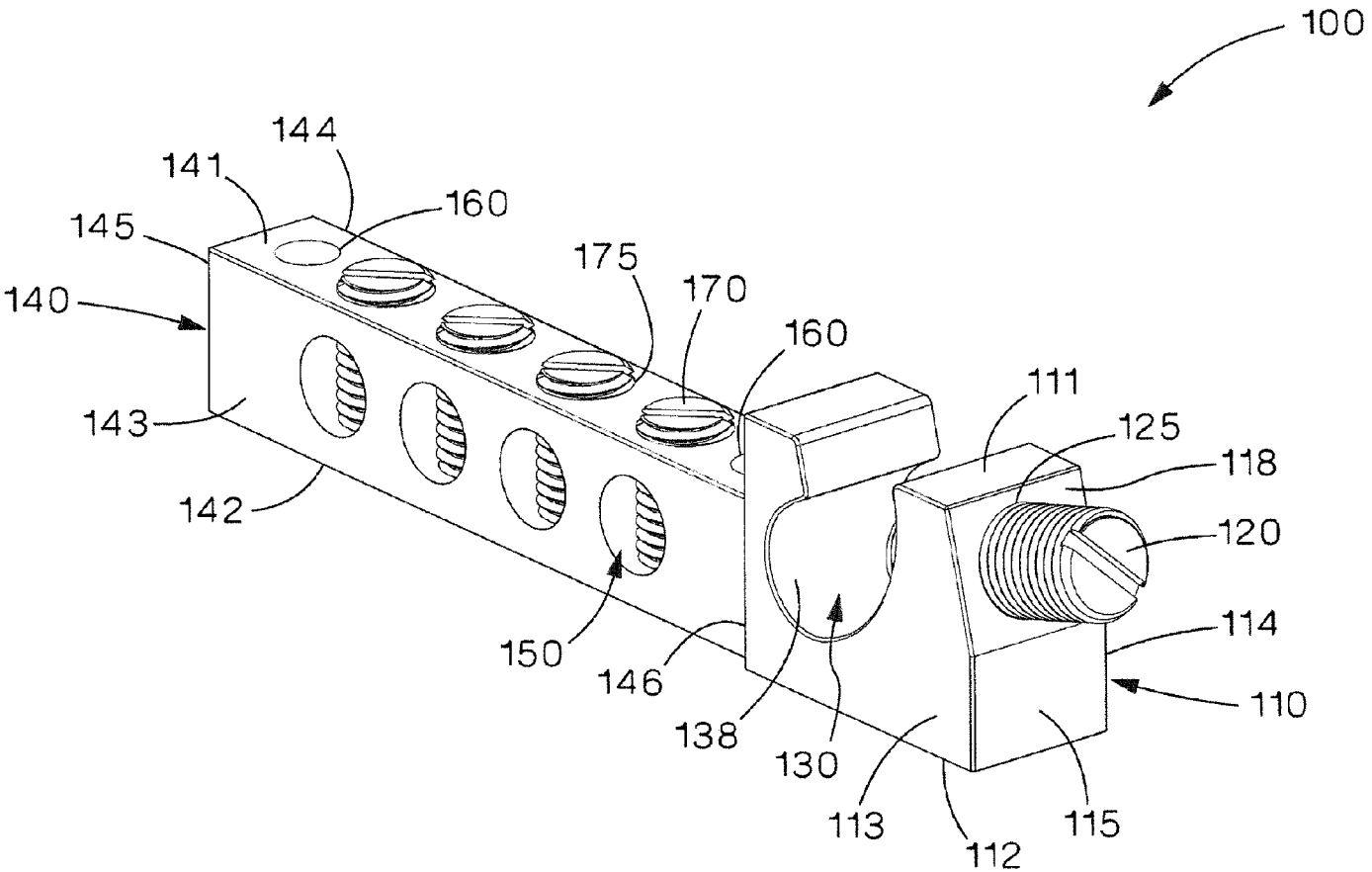
FIG. 2 is a perspective view of the termination bar of the termination bar assembly of FIG. 1.

With reference to FIG. 2, a termination bar 100 includes a first portion 110 and a second portion 140. First portion 110 has a top surface 111, a bottom surface 112, two opposing side surfaces 113, 114, an end surface 115 and angled surface 118. As shown in FIG. 2, the top surface 141 and bottom surface 142 of the second portion 140 are generally planar and parallel and the two opposing side surfaces 143, 144 of the second portion 140 also share this configuration, such that the termination bar 100 comprises a rectangular cross-section along the majority of its length.

A main groove 130 accommodates a main conductor (not shown) and includes a rounded surface 138 that forms a generally circular (for example, comma-shaped) opening across the front portion 110 for receiving the main conductor. The main groove 130 in termination bar 100 includes an upper gap and open portion that enables the termination bar 100 to be slipped over the main conductor. The main groove 130 also includes a rounded surface 138 to seat the main conductor. The configuration of the main groove 130 allows for insertion of a continuous conductor without the need to separate any connector components, providing a "lay-in" feature.

The first portion 110 includes a main conductor fastening arrangement. In this arrangement, screw 120 travels along a threaded hole 125 to secure a range of conductor sizes or wire gauges against the rounded surface 138 of the main groove 130. Threaded hole 125 is located on the angled surface 118 at the outer end 115 of the first portion 110 and intersects main groove 130. Threaded hole 125 is positioned at an acute angle in reference to a horizontal plane defined by the top surface 111 of the first portion 110. This arrangement provides easier access to screw 120. In another embodiment, threaded hole 125 can be positioned generally or entirely above the horizontal plane at an angle.

The second portion 140 has a top side 141, a bottom side 142, a first side 143, a second side 144, a first end 145 and a second end 146. Opening 150 perpendicularly traverses the second portion 140 from the first side 143 to the second side 144, forming a through hole defined by sides 143, 144 for the insertion of electrical conductors, preferably conductors from one or more systems. Second portion 140 can include any number of openings from one to ten. Preferably, second portion 140 has at least four openings as shown in FIG. 2.

The second portion 140 also includes an electrical conductor fastening arrangement. In this arrangement, threaded holes 175 located on the top surface 141 of the termination bar 100 intersect each of the openings 150 on the sides 143, 144 of the termination bar 100.

Terminal screw 170 positioned in threaded hole 175 holds conductors in position. Terminal screw 170 can have slotted tops for screw drivers or any other number of tops, including for example hex sockets and the like. Terminal screw 170 can secure a conductor within a range of sizes or wire gauges. In some embodiments, terminal screw 170 can be a cap screw or a set screw. Openings 150 can receive conductors from, for example, multiple systems such as cable TV, satellite dish, communication device, telephone, computer system, etc.

Figure 7:
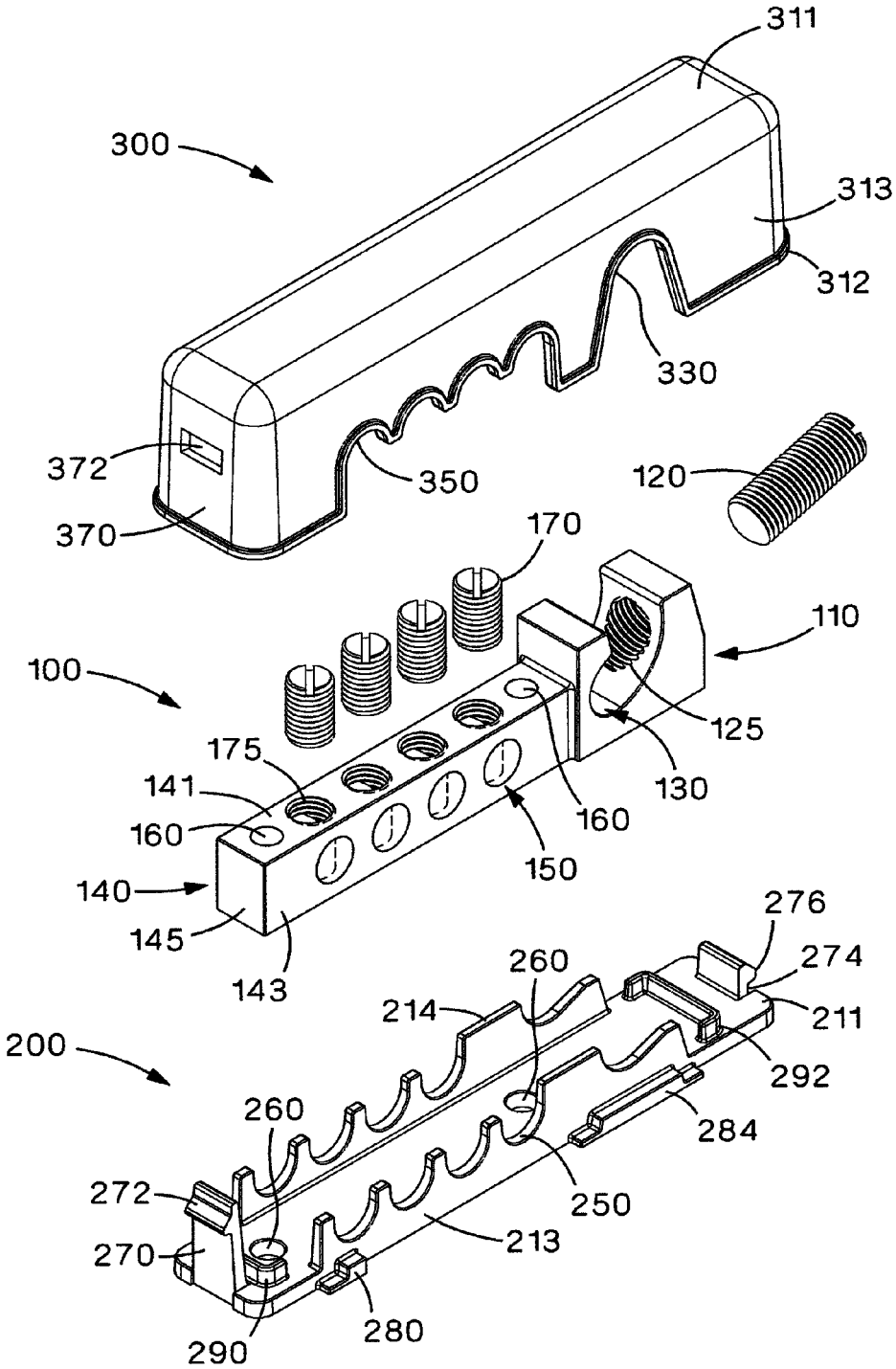
FIG. 7 is an exploded view of the termination bar assembly of FIG. 1.

One or more mounting holes 160 can traverse from top surface 141 to the bottom surface 142 of the second portion 140. The mounting hole 160 can accommodate fasteners, for example screws, for attaching or affixing termination bar 100 to a structure, such as a wall of a building. Preferably, mounting holes 160 align with corresponding mounting holes 260 on base 200, as shown in FIG. 7. In this fastening arrangement, bottom surface 112, 142 of termination bar 100 is secured to top surface 211 of base 200, and the bottom surface of base 212 is secured to a structure, such as a building wall.

Figure 3:
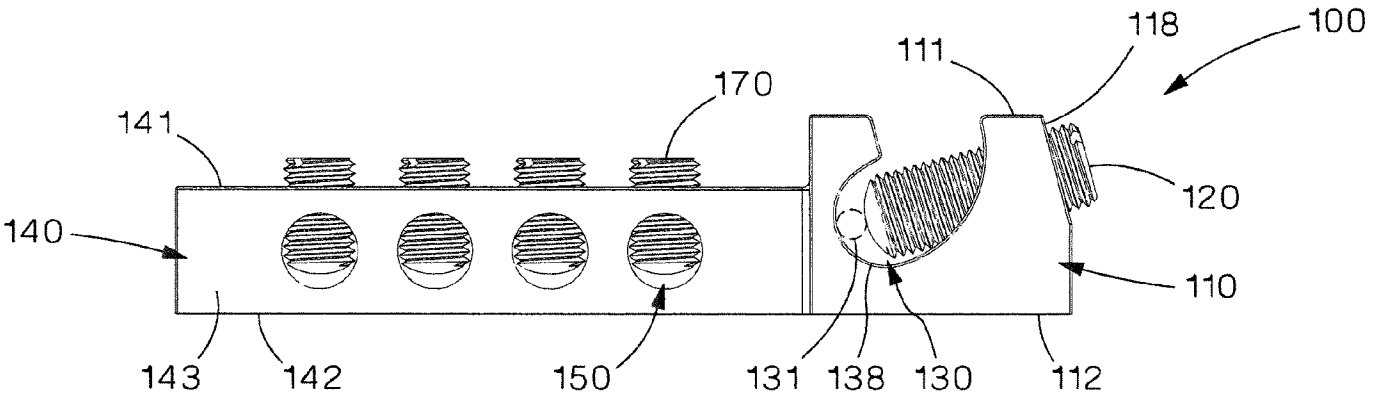
FIGS. 3 and 4 are side views of the termination bar of FIG. 1.
Figure 4:
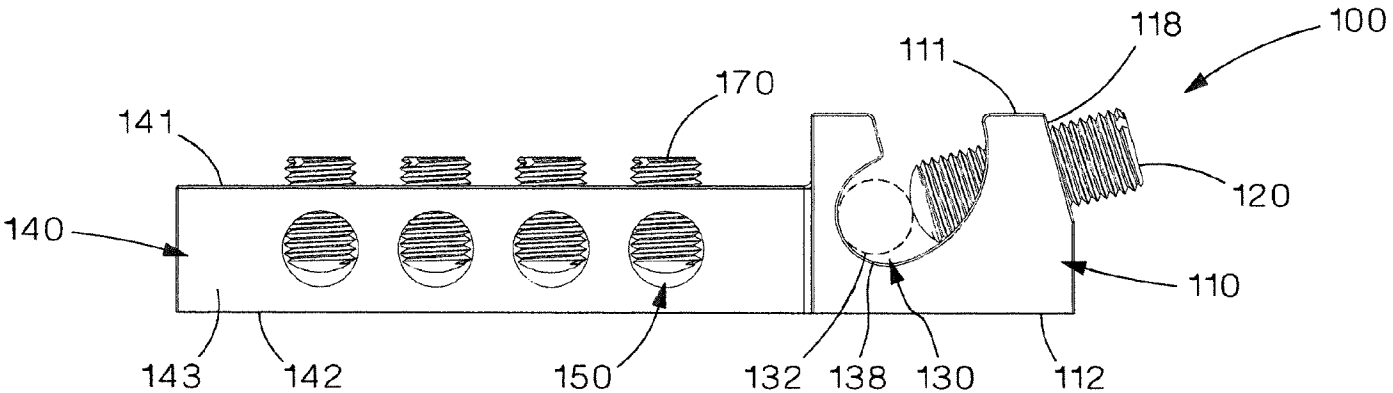

With reference to FIGS. 3 and 4, phantom line 131 represents a smaller gauge conductor (FIG. 3) and phantom line 132 represents a larger gauge conductor (FIG. 4) secured in main groove 130 by the main conductor fastening arrangement. The clamping arrangement is capable of being disposed in a lay-in position for receiving the main conductor 131 or 132. To secure a smaller gauge conductor in the main groove 130, screw 120 is screwed farther into its threaded hole 125. To secure a larger gauge conductor in the main groove 130, screw 120 is not screwed as far into its threaded hole 125.

Figure 5:
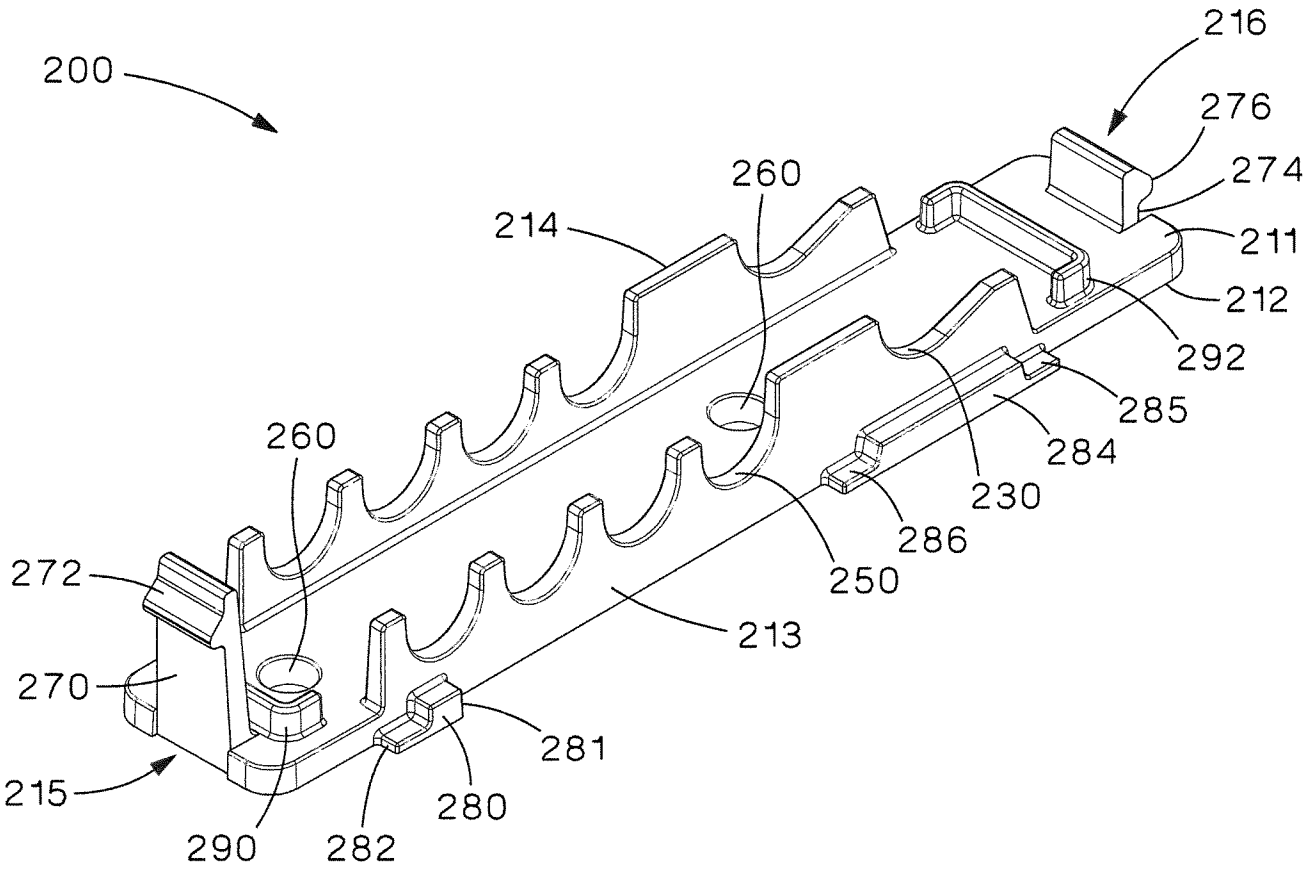
FIG. 5 is a perspective view of the base portion of FIG. 1.

With reference to FIG. 5, base 200 includes a top surface 211, a bottom surface 212, a first side surface 213, a second side surface 214, and two opposing ends 215, 216. The base 200 is preferably rectangular in shape to accommodate termination bar 100. The first side 213 and second side 214 oppose each other and have openings 230 and 250. The openings 230 and 250 are preferably rounded or semicircular as shown in FIG. 5.

Base 200 comprises a snap-in arrangement, with ends 215, 216 of base 200 including a flex tab 270 and a rigid tab 274. Flex tab 270 includes a protrusion 272. Rigid tab 274 includes a protrusion 276. Protrusions 272, 276 can be inward-facing or outward-facing, depending on the specific arrangement of the corresponding mating connectors on dome 300, described below. Preferably, first or second protrusion 272, 276 are outward-facing.

As shown in FIG. 5, a mounting hole 260 traverses the top and bottom surface 211, 212 of base 200. The mounting hole 260 can accommodate fasteners, for example screws, for attaching termination bar 100 to a structure, such as a building wall. Preferably, mounting holes 160 on termination bar 100 align with corresponding mounting holes 260 on base 200.

Still referring to FIG. 5, a first flange or elevation pad 280 is disposed on the first side 213 and/or the second side 214 of the base 200. Elevation pad 280 has a first portion 281 with a first elevation that extends above the bottom surface 212 of base 200. Elevation pad 280 can also have a second portion 282 with a second elevation that extends above the bottom surface 212 of base 200, wherein the first and second elevations are different. In addition, a second flange or elevation pad 284 is disposed on the first side 213 or the second side 214 of the base 200. Elevation pad 284 can also have first portion 285 with a first elevation extending above the bottom surface 212 of base 200. Elevation pad 284 can have second portion 286 with a second elevation extending above the bottom surface 212 of base 200, wherein the first and second elevations are different. In the assembled configuration, the elevation pads 280, 284 prevent the bottom edge surface 312 of dome 300 from contacting the wall or other surface to which base 200 is attached. Preferably, in the assembled configuration 10, the second elevations of the second portion 282, 286 of elevation pads 280, 284 abut corresponding portions of the bottom edge surface 312 of dome 300. In some embodiments, elevation pads 280 and 284 comprise a portion exhibiting a substantially L-shaped profile.

Optionally, base 200 has at least one projection defining a first fence 290 and a second fence 292 located on top surface 211 for receiving and aligning termination bar 100. Fences 290, 292 aid in the initial positioning of termination bar 100 until both termination bar 100 and base 200 are secured to a structure or mounting surface, for example, a wall.

Figure 6:
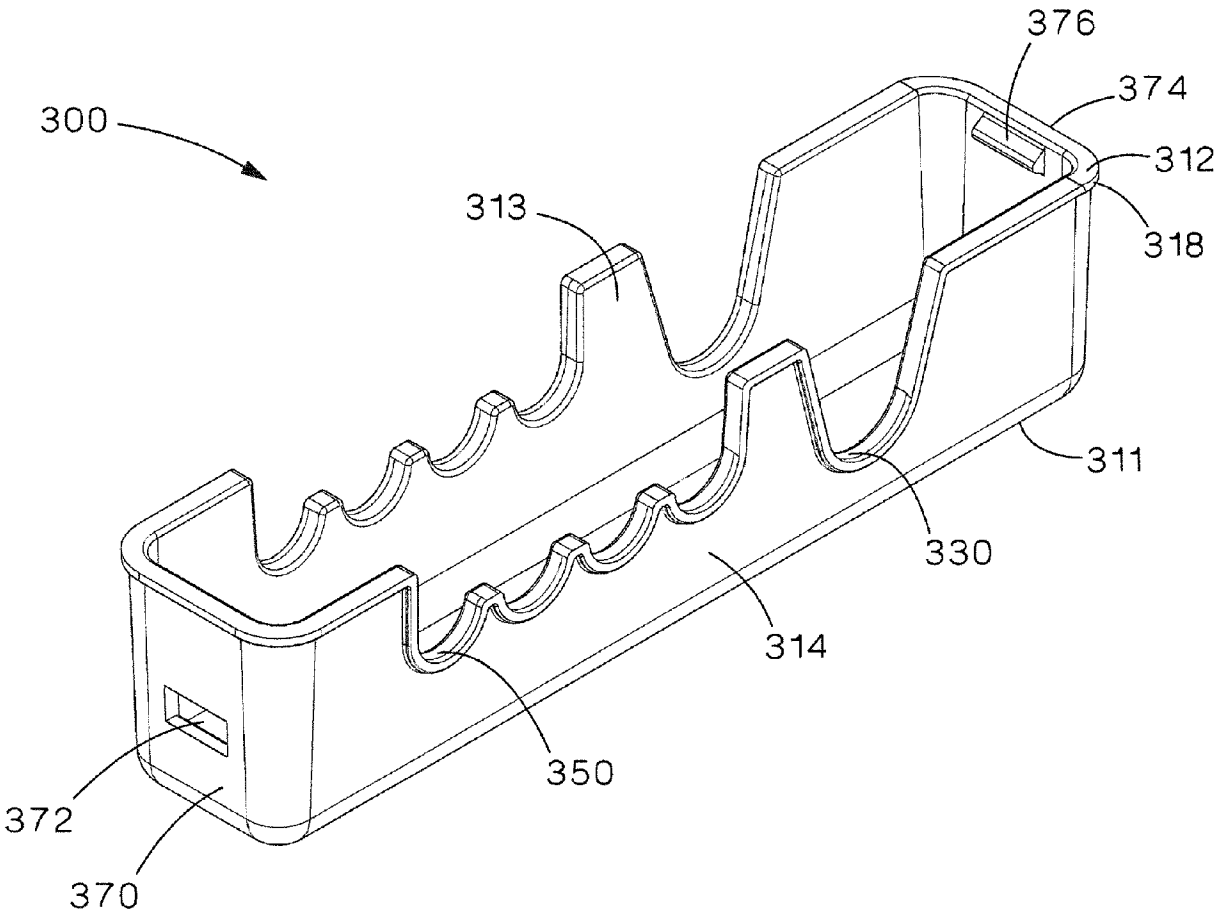
FIG. 6 is a perspective view of the dome portion of the termination bar assembly of FIG. 1.

Referring now to FIG. 6, dome 300 includes a top surface 311, bottom edge surface 312, two opposing sides 313, 314 and two opposing ends 370, 374. The dome 300 can be configured to be releasably securable to base 200. The dome 300 and base 200 are generally rectangular in the preferred embodiments of the invention as shown in FIG. 6. A lip 318 can be disposed about the bottom edge 312 of dome 300.

Figure 14:
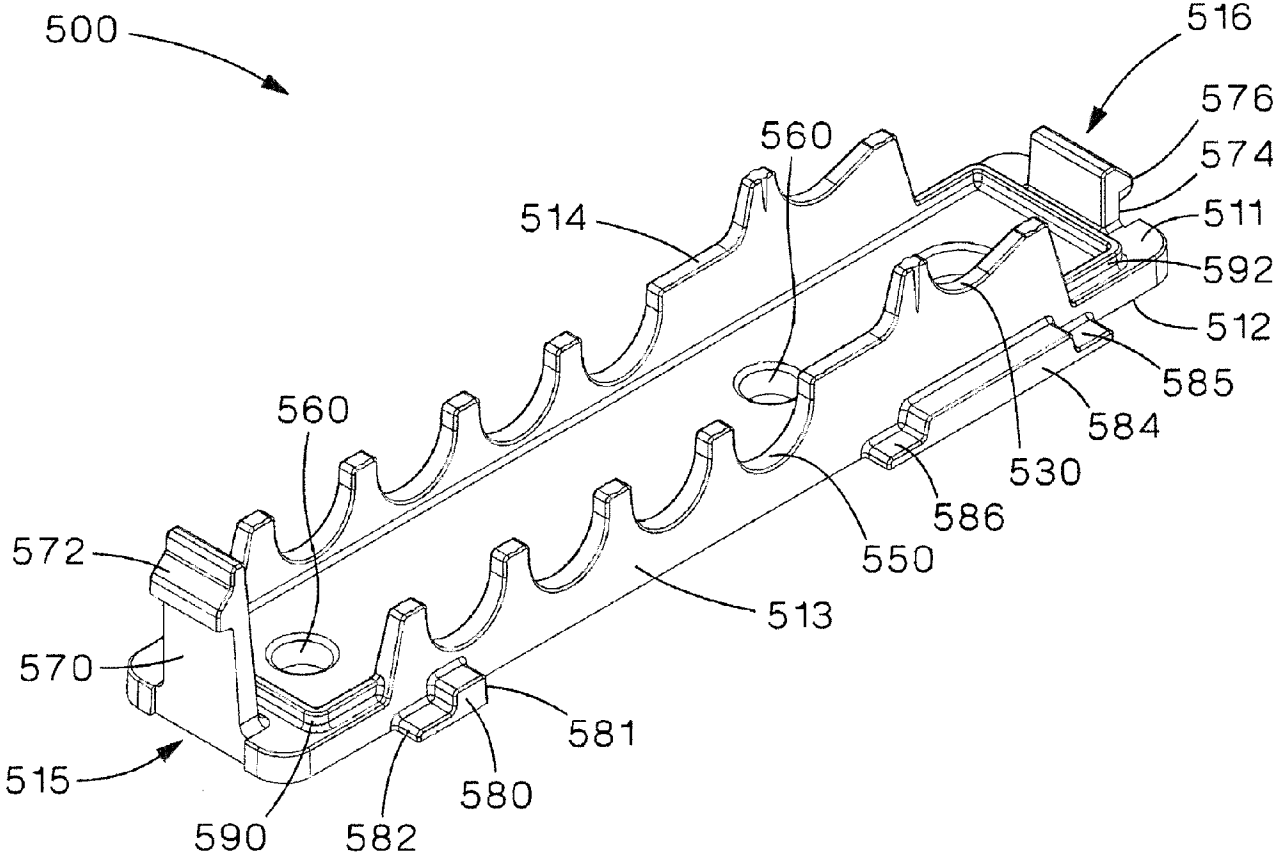
FIG. 14 is a front perspective view of the base portion of the termination bar assembly of FIG. 1.

As shown in FIG. 6, end 370 can include a window 372 to connect with protrusion 272 on the flex tab 270 of base 200. The opposite end 374 can have a protrusion 376 to correspond with protrusion 276 on the rigid tab 274 of base 200 (or protrusion 576 on rigid tab 574 of base 500 as shown in FIG. 14). Tabs 270 and windows 372 can, of course, be positioned on either or both of base 200 or dome 300.

Dome 300, like base 200, has openings 330 in sides 313, 314 that generally correspond to main groove 130 in termination bar 100 and to openings 230 in base 200 when assembled; that is, when dome 300 is secured to base 200. Dome 300 also has openings 350 in sides 313, 314 that generally correspond to openings 150 in termination bar 100 and to openings 250 in base 200 when assembled. The openings 350 are preferably rounded semicircular as shown in FIG. 6. The openings 330, 350 allow for the conductors to connect to termination bar 100.

In reference to FIGS. 1 and 7, protrusion 276 on rigid tab 274 of base 200 engages protrusion 376 of dome 300. Flex tab 270 with protrusion 272 can flex away under applied load and spring back after the load is removed. While closing dome 300 onto base 200, protrusion 376 of dome 300 is inserted under protrusion 276 on rigid tab 274 of base 200. To accomplish this insertion, dome 300 can be angled against base 200, so that end 370 of dome 300 having window 372 is initially positioned above protrusion 272. By pressing the dome 300 near end 370, flex tab 270 is flexed inward and protrusion 272 rides against the inner surface of end 370, until protrusion 272 meets window 372 and snaps into it. In this way, dome 300 is removeably secured to base 200, encasing termination bar 100.

To remove dome 300, an instrument, such as a finger or a flat tip screwdriver, can be inserted into window 372 to flex away flex tab 270 while pulling on dome 300, so that protrusion 272 disengages from window 372. Dome 300 can then be taken off by disengaging the opposite end snap-in features 276 and 376. Because dome 300 snaps into place and is held by the snap-in features, no additional fasteners are needed to attach dome 300 to a mounting surface. Moreover, bottom edges 312 of dome 300 are slightly elevated above the surface on which base 200 and termination bar 100 are mounted due to the elevation pads 280, 282 on base 200. This prevents dome 300 from refusing to snap into place, for example, due to an uneven mounting surface.

Figure 8:
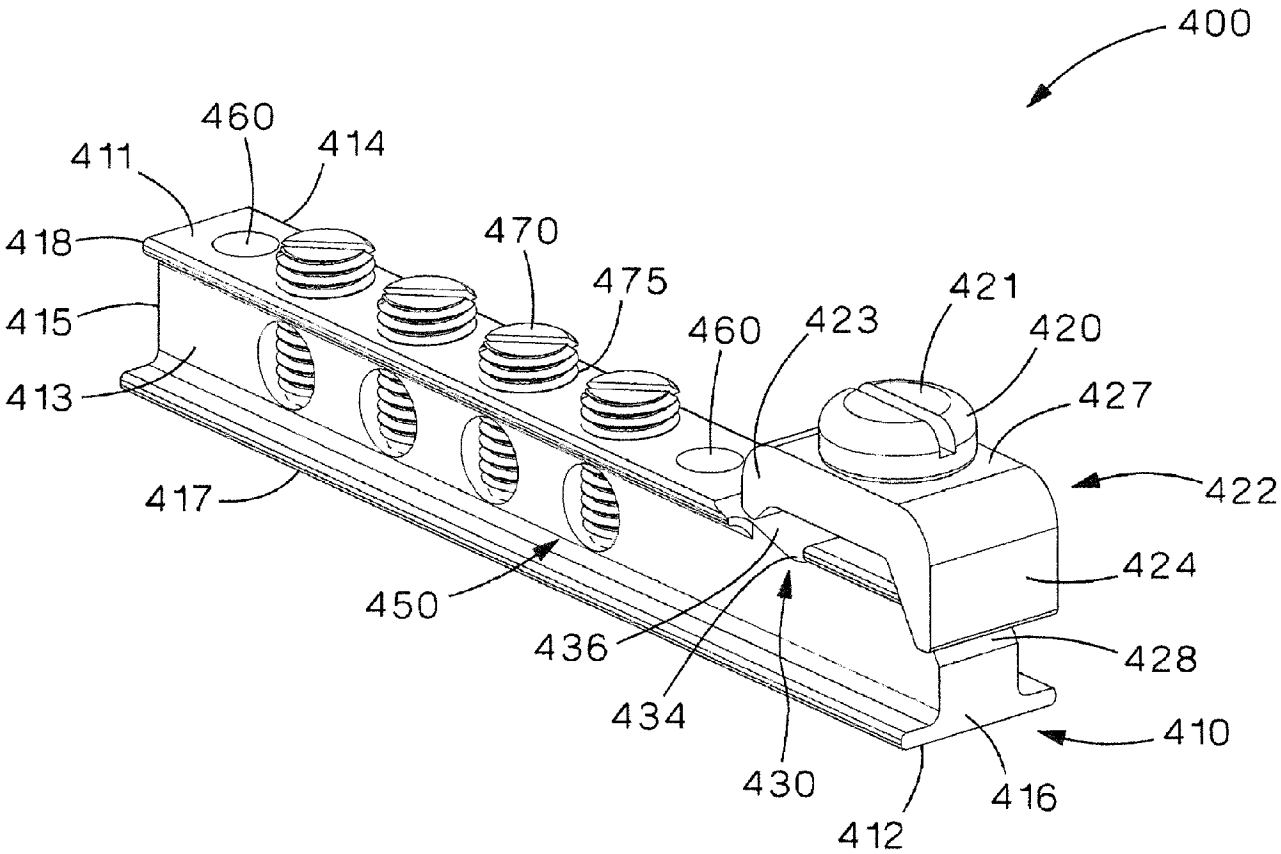
FIG. 8 is a perspective view of another embodiment of the termination bar portion of the termination bar assembly of FIG. 1.
Figure 9:
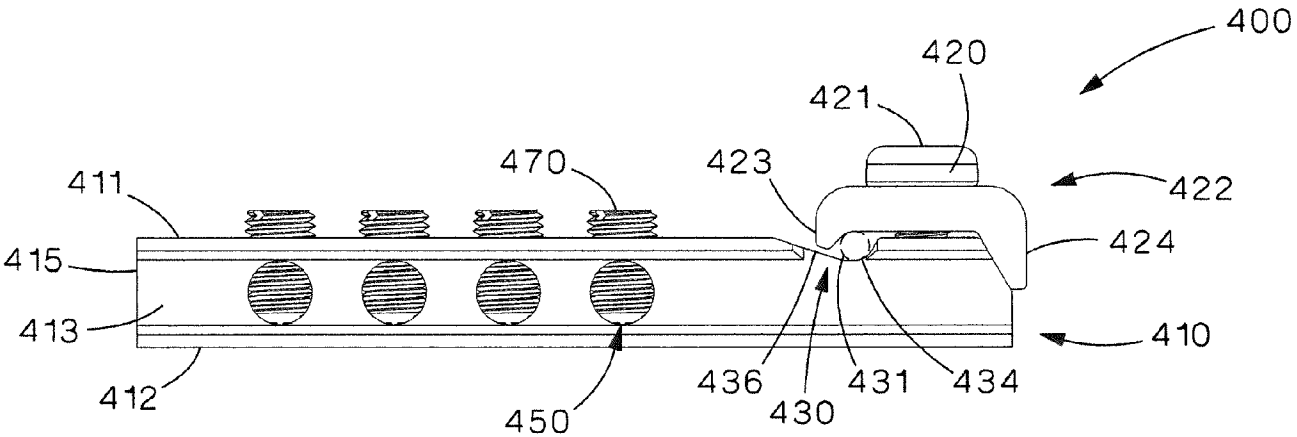
FIGS. 9 and 10 are side views of the termination bar of FIG. 8.
Figure 10:
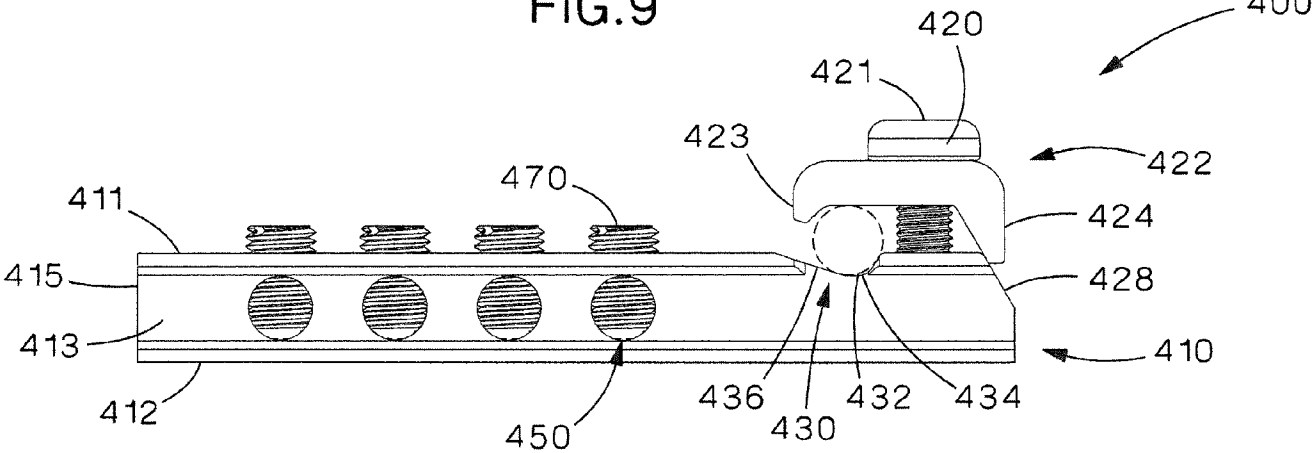

With reference to FIGS. 8, 9, and 10 an alternate embodiment of termination bar 400 is shown. Termination bar 400 comprises a body 410 having a top surface 411, a bottom surface 412, two opposing side surfaces 413, 414 and two opposing end surfaces 415, 416. As shown in FIG. 8, along the bottom surface 412 can be a bottom flange 417. Along the top surface 411 can be a top flange 418. As a result of the top and bottom flanges 417, 418, termination bar 400 can have an I-beam cross-section across the majority of its length.

As best seen in FIGS. 9 and 10, a main groove 430 accommodates a main conductor and includes a surface that forms a generally rounded corner 434 and a flat portion 436 for receiving the main conductor.

The body 410 includes a main conductor clamping arrangement. In this arrangement, clamping pad 422 is disposed above the top surface 411 of body 410 to form a main groove 430. Clamping pad 422 includes a first flange 423, a second flange 424 and a central body portion 427 (see FIG. 8) having an elongated hole 426 (see FIG. 15), which can accommodate a fastener, such as clamping screw 420. The first flange 423 can be a short flange, and the second flange 424 can be a long flange. At least one of the first or second flange 423, 424 comprises an angled surface relative to a horizontal plane, preferably the long flange 424. As shown in FIG. 10, angled surface of the long flange 424 comprises an angle a relative to the horizontal plane between about 30 degrees and about 60 degrees. Clamping screw 420 can be a slotted pan head screw, hex socket head screw, hex head cap crew, or a screw with head having a socket accommodating any other driver tip, such as square, star and the like.

Threaded hole 425 (see FIG. 15) is positioned in top surface 411 next to the main groove 430 in order to accommodate clamping screw 420. An angled surface 428 relative to the horizontal plane is disposed on end surface 416 next to the threaded hole 425. Preferably angled surface 428 comprises angle b relative to the horizontal plane between about 30 degrees and about 60 degrees. As shown in FIG. 10, angle b of angled surface 428 substantially corresponds to angle a of the angled surface of the long flange 424. Even more preferably, angled surface 428 is a chamfer, such as a symmetrical chamfer and with 45° angle relative to a horizontal plane. Clamping screw 420 travels vertically in the threaded hole 425 (see FIG. 15) and positions or holds down the clamping pad 422, allowing the clamping pad 422 to travel slidingly on angled surface 428 and to secure a main conductor within a range of sizes or wire gauges. Preferably, clamping pad 422 is machined from a single piece of metal, from an extruded profile or in the form of casting.

The body 410 of termination bar is similar to that of the first embodiment, as shown in FIG. 2. It includes openings 450 that perpendicularly traverse the first side 413 to the second side 414, forming a through hole defined by sides 413, 414 for the insertion of electrical conductors, preferably grounding conductors from one or more systems. The body 410 can include any number of openings 450 from one to ten. Preferably, the body 410 has at least four openings as shown in FIG. 8.

The body 410 also includes an electrical conductor fastening arrangement. In this arrangement, threaded holes 475 located on the top surface 411 of the termination bar 400 intersect each of the openings 450 on the sides 413, 414 of the termination bar 400.

Each opening 450 has a terminal screw 470 which travels in a threaded hole 475 perpendicularly connected from the top side 411 to the opening 450. Terminal screw 470 can have slotted tops for screw drivers or any other number of tops, including for example hex sockets and the like. In some embodiments, terminal screw 470 can be a cap screw or a set screw. One or more mounting holes 460 can traverse from top surface 411 to the bottom surface 412 of the body 410. The mounting hole 460 can accommodate fasteners, for example screws, for attaching termination bar 400 to a mounting surface or a structure, such as a wall. Preferably, mounting holes 460 align with corresponding mounting holes 560 on base 500. In this fastening arrangement, bottom surface 412 of termination bar 400 is secured to top surface 511 of base 500, and the bottom surface 512 of base 500 is secured to a structure, such as a building wall.

With reference to FIGS. 9 and 10, phantom line 431 represents a smaller gauge conductor (FIG. 9) and phantom line 432 represents a larger gauge conductor (FIG. 10) secured in main groove 430 by the main conductor fastening arrangement. The clamping arrangement is capable of being disposed in a lay-in position for receiving the main conductor. Short flange 423 of clamping pad 422 pushes a main conductor into a rounded corner 434 of the main opening 430 on the body 410. The long flange 424 of clamping pad 422 slides on angled surface 428 on the body 410. As illustrated in FIG. 8, the central body portion 427 of clamping pad 422 presses on the main conductor downward onto flat portion 436. As the main conductor partially flattens under that pressure, it presses on the short flange 423. This pressure, in turn, forces clamping pad 422 to stay in an approximately horizontal position as long flange 424 abuts angled surface 428. In the case of using a smaller size main conductor, the central horizontal portion 427 may eventually rest on the flat portion 436 of the top surface 411 of the body 410, when the clamping operation is complete.

Figure 11:
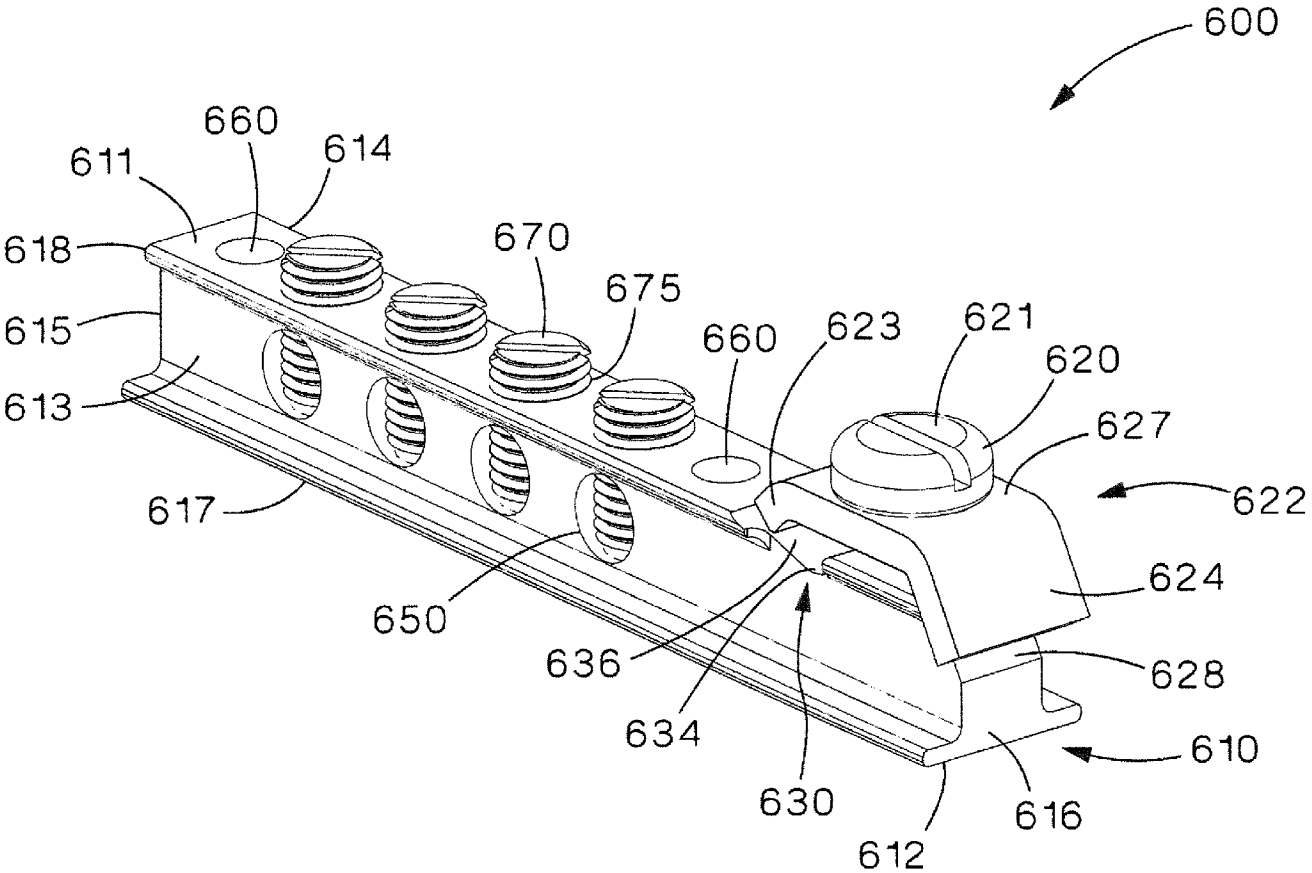
FIG. 11 is a front perspective view of yet another embodiment of the termination bar portion of the termination bar assembly of FIG. 1.
Figure 12:
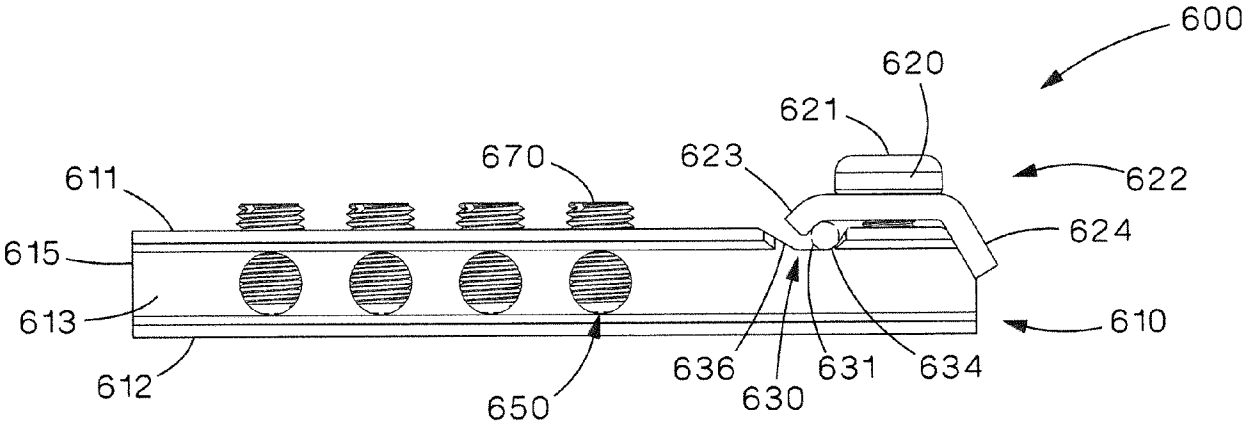
FIGS. 12 and 13 are side views of the termination bar of FIG. 11.
Figure 13:
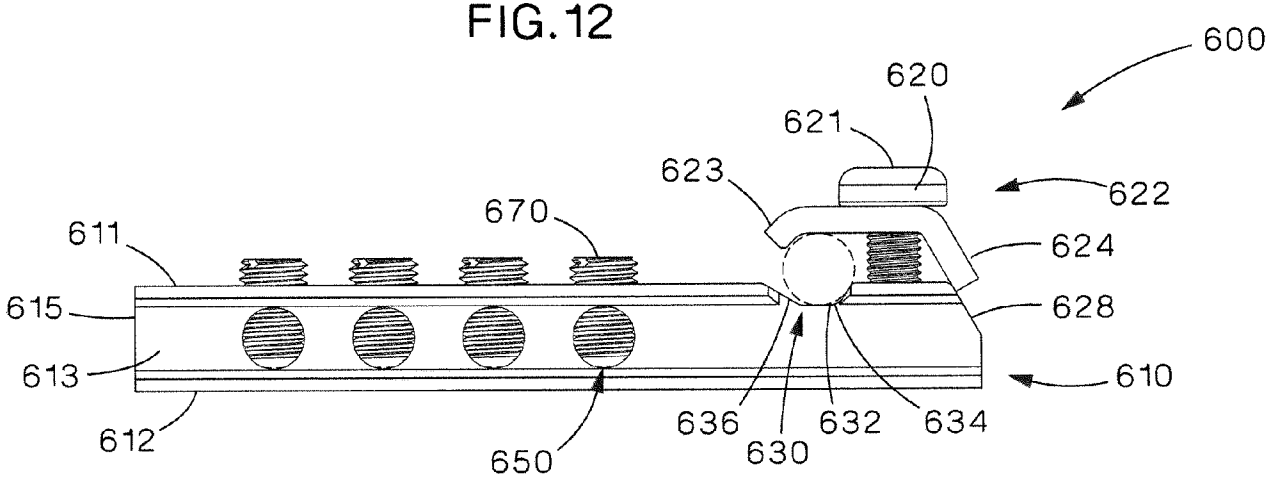

With reference to FIG. 11, yet another embodiment of the main conductor fastening arrangement is shown. A termination bar 600 includes features that generally correspond to those similarly identified in termination bar 400: body 610, top side 611, bottom side 612, first side 613, second side 614, first end 615, second end 616, bottom flange 617, top flange 618, clamping screw 620, threaded hole 625 (see FIGS. 12 and 13), angled surface 628 relative to a horizontal plane on the termination bar have an angle d, main opening 630, rounded corner 634, flat portion 636, opening 650, mounting holes 660, terminal screw 670 and threaded hole 675. Clamping pad 622 has a central body portion 627 with an elongated hole 626 and disposed between a short flange 623 and a long flange 624 having an angled surface relative to the horizontal plane with an angle c. In this embodiment, clamping pad 622 can be formed by stamping, cutting and/or bending from a piece of sheet metal. Preferably, angle d of angled surface 628 substantially corresponds to angle c of the angled surface of the long flange 624. Clamping screw 620 can be a slotted pan head screw, hex socket head screw, hex head cap crew, or a screw with head having a socket accommodating any other driver tip, such as square, star and the like. With reference to FIGS. 12 and 13, phantom line 631 represents a smaller gauge conductor (FIG. 12) and phantom line 632 represents a larger gauge conductor (FIG. 13) secured in main groove 630 by the main conductor fastening arrangement.

These main conductor fastening arrangements ensure that clamping pad 422 or 622 remains in a position that is generally parallel to the top surface 411 or 611 of body 410 or 610 and to the bottom surface of a head 421, 621 of the clamping screw 420 or 620, regardless of size or gauge of the main conductor. This arrangement thus distributes the clamping force across the main conductor in the range of typical sizes.

In reference to FIG. 14, base 500 can have an alternative arrangement of fences 590, 592. Other features in base 500 generally correspond to those similarly identified in base 200: top surface 511, bottom surface 512, first side surface 513, second side surface 514, first end 515, second end 516, main groove opening 530, openings 550, mounting hole 560, flex tab 570, protrusion 572, rigid tab 574, protrusion 576, first and second elevation pads 580, 584 with first portions 581, 585 having a first elevation and second portions 582, 586 having a second elevation.

Figure 15:
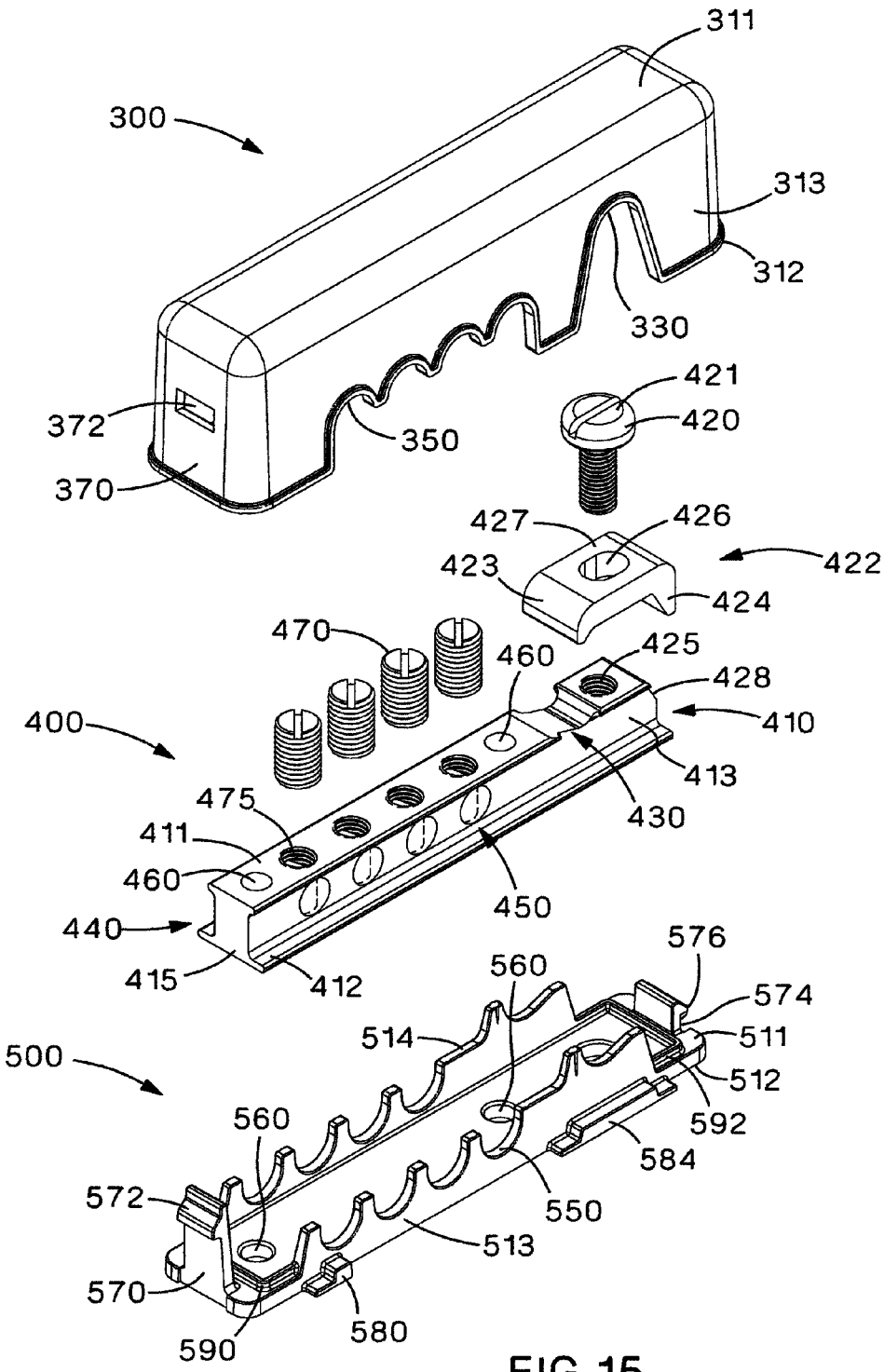
FIG. 15 is an exploded view of the termination bar assembly of FIG. 1 with the termination bar of FIG. 8.

In reference to FIGS. 6 and 15, the protrusion 576 on rigid tab 574 of base 500 engages protrusion 376 of dome 300. Flex tab 570 with protrusion 572 can flex away under applied load and spring back after the load is removed. While closing dome 300 onto base 500, protrusion 376 of dome 300 is inserted under protrusion 576 on rigid tab 574 of base 500. To accomplish this insertion, dome 300 can be angled against base 500, so that end 370 of dome 300 having window 372 is initially positioned above protrusion 572. By pressing the end of dome 300 near end 370, flex tab 570 is flexed inward and protrusion 572 rides against the inner surface of end 370, until protrusion 572 meets window 372 and snaps into it. In this way, dome 300 is removably securable to base 500, holding and encasing termination bar 400.

To remove dome 300, an instrument, such as a finger or a flat tip screwdriver, can be inserted into window 372 to flex away flex tab 572 while pulling on dome 300, so that protrusion 572 disengages from window 372. Dome 300 can then be taken off by disengaging the opposite end snap-in features 376 and 576. Because dome 300 snaps into place and is held by the snap-in features, no additional fasteners are needed to attach dome 300 to a mounting surface. Moreover, bottom edges 312 of dome 300 are slightly elevated above the surface on which base 500 and termination bar 400 are mounted due to the elevation bars 580, 584 on base 500. This can prevent dome 300 from refusing to snap into place, for example, due to an uneven mounting surface.

As previously mentioned, termination bars 100, 400 and 600 may be installed on a structure with or without its cover. When the cover is employed, the mounting holes of the base and the termination bar are aligned and a mounting screw driven into place.

Termination bars 100, 400 and 600 are preferably metallic and even more preferably are made from one or more compatible metals such as copper, aluminum, brass and other zinc alloys, including alloys of zinc with one or more metals selected from the group consisting of aluminum, magnesium and copper.

Bases 200 and 500 and dome 300 are preferably non-metallic and even more preferably are made of a polymeric material such as polypropylene, polyoxymethylene, polycarbonate, and polyethylene terephthalate.

It is recognized that various modifications are possible within the scope of the claimed invention. Thus, it should be understood that, although the present invention has been specifically disclosed in the context of preferred embodiments and optional features, those skilled in the art may resort to modifications and variations of the concepts disclosed herein. Such modifications and variations are considered to be within the scope of the invention as defined by the appended claims.

What is claimed is:

1. A termination bar assembly comprising:

a termination bar including opposing ends, a top surface and opposing side surfaces, wherein the opposing side surfaces define a plurality of openings for receiving one or more electrical conductors, the termination bar further comprising an opening for receiving a main conductor;

a clamping arrangement associated with the termination bar for receiving and holding the main conductor, the clamping arrangement capable of being disposed in a lay-in position for receiving said main conductor, said clamping arrangement comprising a central body portion overlaying said opening and at least one flange extending therefrom; and a detachable cover having a base for receiving said termination bar and affixing said termination bar to a mounting surface, a dome releasably securable to said base, and at least one flange positioned on a side surface of said base, said at least one flange for elevating said dome above said mounting surface when said dome is secured to said base.

2. The termination bar assembly of claim 1, wherein said at least one flange comprises an angled surface relative to a horizontal plane and said termination bar comprises an angled surface relative to the horizontal plane lying at substantially the same angle as the angled surface of said at least one flange.

3. The termination bar assembly of claim 1, wherein said at least one flange comprises a first flange and a second flange positioned on opposing sides of said central body portion, wherein each of said first and second flanges comprises an angled surface.

4. The termination bar assembly of claim 1, wherein said clamping arrangement comprises a screw and said central body comprises a hole for receipt of said screw.

5. The termination bar assembly of claim 1, wherein said dome and base comprise a snap-in connector arrangement comprising a tab and a receptacle for receipt of said tab, said tab and receptacle positioned on either or both of said base and dome.

6. The termination bar assembly of claim 1, wherein said at least one flange positioned on said side surface of said base comprises a first portion at a first elevation and a second portion at a second elevation, wherein said first and second elevations are different.

7. A termination bar assembly comprising:

a termination bar including opposing ends, a top surface and opposing side surfaces, wherein the opposing side surfaces define a plurality of openings for receiving one or more electrical conductors, the termination bar further comprising an opening for receiving a main conductor;

a clamping arrangement associated with the termination bar for receiving and holding the main conductor and comprising a central body portion positioned to overlay said opening, said clamping arrangement capable of being disposed in a lay-in position for receiving said main conductor, said clamping arrangement configured to resist rotation when the main conductor is being secured in position; and a detachable cover having a base for receiving said termination bar and affixing said termination bar to a mounting surface, a dome releasably securable to said base, and at least one flange positioned on a side surface of said base, said at least one flange for elevating said dome above said mounting surface when said dome is secured to said base.

8. The termination bar assembly of claim 7, wherein said central body portion is positioned between a first flange and a second flange, wherein each of said first and second flanges comprises an angled surface relative to a horizontal plane.

9. The termination bar assembly of claim 7, wherein said clamping arrangement comprises a screw and said central body portion comprises a hole for receipt of said screw.

10. The termination bar assembly of claim 7, wherein either or both of said base and dome comprises a tab and receptacle for releasable securement.

11. The termination bar assembly of claim 7, wherein said at least one flange positioned on said side surface of said base comprises a first portion at a first elevation and a second portion at a second elevation, wherein said first and second elevations are different.

12. A termination bar assembly of claim 7, wherein the termination bar further comprising an angled surface relative to a horizontal plane; and the central body portion positioned between a first flange and a second flange, wherein each of said first and second flanges comprises an angled surface relative to the horizontal plane, with an angled surface of at least one of said flanges lying at substantially the same angle as an angled surface of said termination bar.

13. A termination bar assembly comprising:

a termination bar including opposing ends, a top surface and opposing side surfaces, wherein the side surfaces define a plurality of openings for receiving one or more electrical conductors, including a main conductor;

a clamping arrangement associated with the termination bar for receiving and holding the main conductor, the clamping arrangement capable of being disposed in a lay-in position for receiving said main conductor;

a base for holding said termination bar and affixing said termination bar to a mounting surface;

a dome releasably securable to said base; and at least one flange positioned on a side surface of said base, said at least one flange for elevating said dome above said mounting surface when said dome is secured to said base.

14. The termination bar assembly of claim 13, wherein said at least one flange positioned on said side surface of said base comprises a first portion at a first elevation and a second portion at a second elevation, wherein said first and second elevations are different.

15. The termination bar assembly of claim 13, wherein said at least one flange comprises a portion exhibiting a substantially L-shaped profile.

16. The termination bar assembly of claim 13, wherein said clamping arrangement is configured to resist rotation when the main conductor is being secured in position.

17. The termination bar assembly of claim 16, wherein said clamping arrangement comprises a central body portion and first and second flanges extending therefrom.

18. The termination bar assembly of claim 13, wherein said termination bar comprises an angled opening for receiving a screw to secure said main conductor into position.

* * * * *